United States Patent [19]

Asbill, III

[11] 4,165,139

[45] Aug. 21, 1979

[54] MANIFOLDING MEANS AND SYSTEM FOR ELECTRICAL AND/OR PNEUMATIC CONTROL DEVICES AND METHOD

[75] Inventor: Clarence M. Asbill, III, Richmond, Va.

[73] Assignee: Robertshaw Controls Company, Richmond, Va.

[21] Appl. No.: 875,950

[22] Filed: Feb. 7, 1978

Related U.S. Application Data

[62] Division of Ser. No. 780,038, Mar. 22, 1977, Pat. No. 4,093,329.

[51] Int. Cl.[2] ..... H01R 3/04

[52] U.S. Cl. ..... 339/15; 137/269; 137/861

[58] Field of Search ..... 339/15, 16; 137/269, 137/608

[56] References Cited

U.S. PATENT DOCUMENTS 3,513,876 5/1970 Tarbox ..... 137/269 X

*Primary Examiner*—Roy Lake
*Assistant Examiner*—DeWalden W. Jones
*Attorney, Agent, or Firm*—Candor, Candor & Tassone

[57] ABSTRACT

A manifold adapted to detachably carry on one side thereof a plurality of pneumatically and electrically operated control units each of which is adapted to be fluidly and electrically interconnected to pneumatic structure and electrical structure of the manifold. That one side of the manifold has external interconnecting structure for the pneumatic structure and the electrical structure whereby external pneumatic and electrical lines can be interconnected to the same side of the manifold that the units are adapted to be interconnected thereto.

10 Claims, 4 Drawing Figures

MANIFOLDING MEANS AND SYSTEM FOR ELECTRICAL AND/OR PNEUMATIC CONTROL DEVICES AND METHOD

This is a division of application Ser. No. 780,038, filed Mar. 22, 1977, now U.S. Pat. No. 4,093,329.

This invention relates to an improved manifold system and manifold means therefor as well as to a method of making such a manifold means.

It is well known that a manifold means has been provided for supplying the fluid and electrical current needed by a plurality of pneumatically and/or electrically operated control units that can be detachably secured to the manifold means. For example, see the U.S. Pat. to Bullmer, No. 3,572,368 and the U.S. Pat. to Tarbox, No. 3,513,876.

However, it was found according to the teachings of this invention that such prior known manifold means while permitting all of the desired number of pneumatically and electrically operated control units to be detachably secured to one side of the manifold means, complicated arrangements were provided for interconnecting the external pneumatic and electrical lines to the manifold means whereby installation and repair in the field of such manifold systems are realitively difficult and complicated. For example, the external electrical lines are attached in one prior known arrangement, to the side of the manifold means opposite to the exposed side of the manifold means that receive the control units.

Thus, it is a feature of this invention to provide a manifold system wherein not only are the pneumatically and electrically operated control units readily detachably secured to one side of the manifold means thereof, but also the external pneumatic and electrical lines are interconnected to the same side of the manifold means that the control units are interconnected thereto to facilitate the ease of installation and repair of such a manifold system.

In particular, one embodiment of this invention provides a manifold means adapted to detachably carry on one side thereof a plurality of pneumatically and electrically operated control units each of which is adapted to be fluidly and electrically interconnected to pneumatic means and electrical means of the manifold means. The one side of the manifold means has external interconnection means for the pneumatic means and the electrical means thereof whereby external pneumatic and electrical lines can be interconnected to the same side of the manifold means that the units are adapted to be interconnected thereto.

Accordingly, it is an object of this invention to provide an improved manifold system having one or more of the novel features of this invention as set forth above or hereinafter shown or described.

Another object of this invention is to provide an improved manifold means for such a manifold system or the like, the manifold means of this invention having one or more of the novel features of this invention as set forth above or hereinafter shown or described.

Another object of this invention is to provide a method of making such a manifold means, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein.

Figure 1:
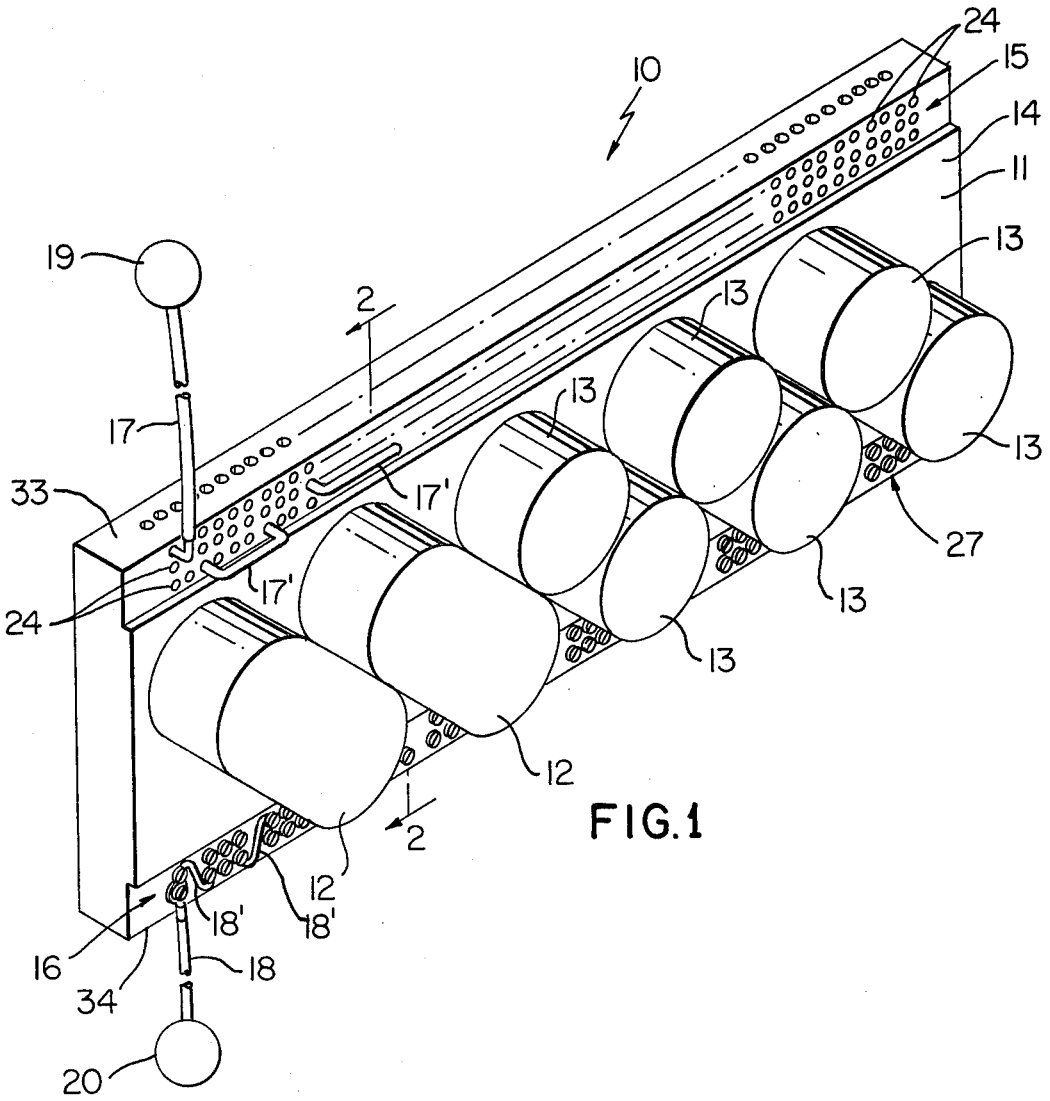
FIG. 1 is a perspective view of the improved manifold system of this invention.

While the various features of this invention are hereinafter described and illustrated as being particularly adapted to provide a manifold means for pneumatically and electrically operated control units, it is to be understood that the various features of this invention can be utilized singly or in any combination thereof to provide manifold means for other types of units as desired, such as control units that are only pneumatically operated or just electrically operated or a combination thereof.

Therefore, this invention is not to be limited to only the embodiments illustrated in the drawings, because the drawings are merely utilized to illustrate one of the wide variety of uses of this invention.

Figure 2:
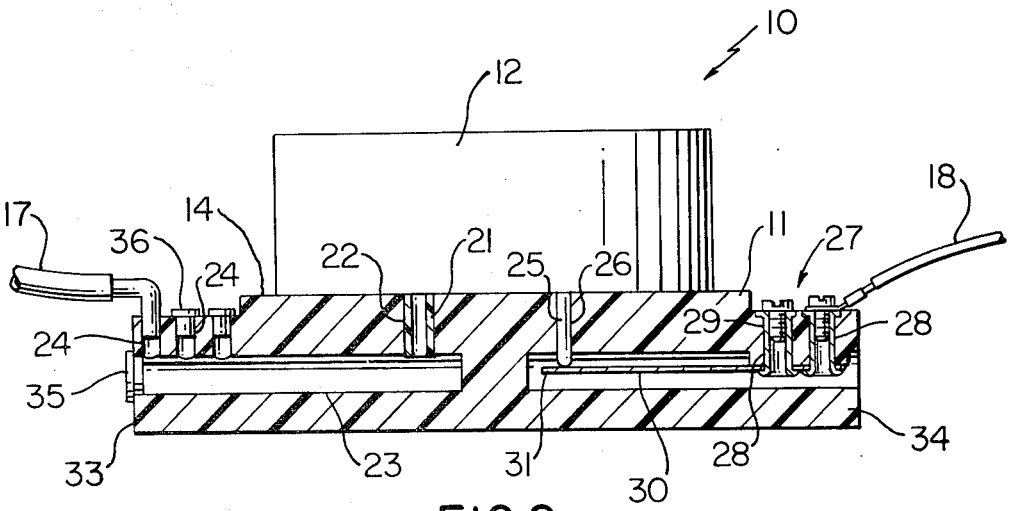
FIG. 2 is an enlarged cross-sectional view taken substantially on line 2—2 of FIG. 1.
Figure 3:
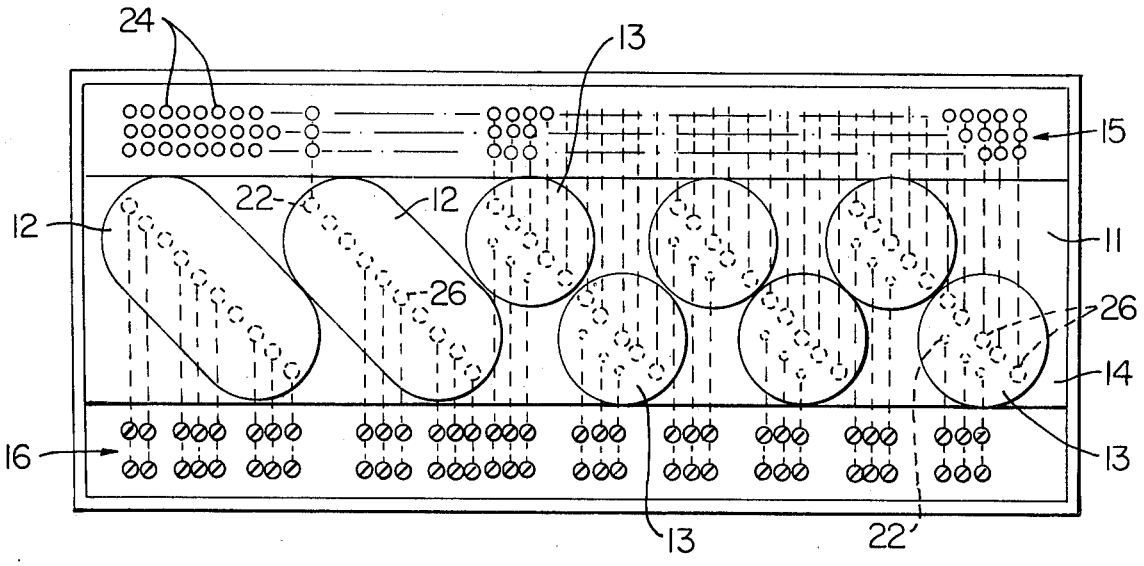
FIG. 3 is a top view of the manifold system of FIG. 1.

Referring now to FIGS. 1, 2 and 3, the improved manifolding system of this invention is generally indicated by the reference numeral 10 and comprises a manifold means 11 detachably carrying a plurality of pneumatically and electrically operated control units 12 and 13 on one side 14 thereof that also has an upper row of interconnection means generally indicated by the reference numeral 15 and a lower row of interconnection means generally indicated by the reference numeral 16 for respectively being interconnected to external pneumatic lines 17 and external electrical lines 18 for respectively supplying fluid and electrical current from suitable sources 19 and 20 external to the manifold system 10 to operate the control devices 12 and 13 in a manner well known in the art for any desired purpose, such as for controlling the heating and cooling systems for a large building and the like.

In addition, the interconnection means 15 of the manifold means 11 is utilized for interconnecting external pneumatic lines 17' between the control units 12 and/or 13 as illustrated in FIG. 1. Likewise, the interconnection means 16 of the manifold means 11 is utilized for interconnecting external electrical lines 18' between the control units 12 and/or 13 as illustrated in FIG. 1.

While FIG. 1 only illustrates a few external lines 17, 17', 18 and 18', for the system 10, it is to be understood that the system 10 can utilize any desired number of external lines 17, 17', 18 and 18'.

The manifolding system 10 can be mounted in a control room in any conventional manner, such as being placed and secured inside a control cabinet or the like.

Each control unit 12 and 13 can be provided with one or more plug-in nipples 21, FIG. 2, which are adapted to be received in plug-in recess means 22 formed in the side 14 of the manifold means 11, each recess means 22 interconnecting with an internal passage 23 of the manifold means 11 that defines part of the pneumatic means thereof.

Each passage 23 interconnects with the interconnection means 15 which comprises a plurality of recesses 24 formed in the side 14 of the manifold means 11, three such recesses 24 being provided for each passage 23 and being disposed in spaced aligned relation. The recess means 24 for each passage 23 are disposed in spaced parallel relation with the recess means 24 of the other passages 23 as illustrated in FIGS. 1 and 3.

Thus, the passages 23 provide the pneumatic means of the manifold means 11 for supplying fluid to and from the external lines 17 and/or 17' between the recesses 24 and the recess means 22 leading to the output or input nipple means 21 of the control devices 12 and 13.

Similarly, the control devices 12 and 13 have one or more electrical connection pins 25, FIG. 2, adapted to be plugged into suitable recess means 26 formed in the side 14 of the manifold means 11, each recess means 26 interconnecting with a passage 23' in the manner illustrated in FIG. 2. While the passages 23' may be aligned with the passages 23 as illustrated in FIG. 2, the passages 23' do not interconnect with the passages 23.

The interconnection means 16 for the manifold means 11 comprises a plurality of electrical terminals that are generally indicated by the reference numerals 27 and each comprises a conductive hollow grommet 28 received in an opening 29 passing through the side 14 of the manifold means 11 and interconnecting with a passage 23' to be electrically interconnected to a conductive leaf member 30 that extends through the passage 23' in a manner to have the free end 31 thereof positively engaged by the socket pin 25 of the particular control device 12 or 13 being plugged into the side 14 of the manifold means 11 in the manner illustrated in FIG. 2. Two such grommets 28 are provided for each passage 23' and its associated leaf member 30 as illustrated in FIGS. 1–3 so that one or two external electrical lines 18 and/or 18' can be electrically interconnected to the conductive leaf 30 by a threaded fastening member 32 that forms part of the respective terminal means 27 and is threaded into its respective grommet 28 in the manner illustrated in FIG. 2. In this manner, electrical current from the source 20 can be interconnected by the external leads 18 and 18' and the electrical means 30 of the manifold means 11 to the pins 25 of the control devices 12 and 13 to operate the same in a manner well known in the art.

Thus, it can be seen that by providing a plurality of plug-in recess means 22 and 26 in the side 14 of the manifold means 11 in the manner illustrated in FIG. 3, a desired number of control devices 12 and 13 can be plugged into the manifold means 11 on the side 14 thereof to have the pneumatically and electrically operated structure of the control units 12 and 13 be readily interconnected to the pneumatic means 23 and electrical means 30 of the manifold means 11 which in turn have the interconnection means 15 and 16 thereof interconnected to external pneumatic lines 17 and/or 17' and electrical lines 18 and/or 18' on the same side 14 of the manifold means 11 whereby it is relatively easy to install the manifold means 11 in a cabinet or the like during the initial installation thereof as well as to subsequently interconnect the desired number of external lines 17, 17', 18 and 18' to the desired interconnection means 24 and 27 for the devices 12 and 13 to function in a conventional manner.

In the embodiment of the manifold means 11 illustrated in the drawings, the manifold means 11 comprises a one-piece plastic structure that can be formed by extrusion or the like so that the passages 23 pass substantially parallel to each other and the passages 23' pass substantially parallel to each other, the passages 23 respectively interrupting one opposed end 33 of the manifold means 11 and the passages 23' respectively interrupting the other opposed end 34 of the manifold means 11. The passages 23 can be subsequently closed by suitable flexible sealing plugs 35 at the end 33 of the manifold means 11. The recess means 22, 24 and 26 as well as the opening means 29 can thereafter be bored or otherwise formed in the side 14 of the manifold means 11 to respectively interconnect with the passages 23 and 23' as illustrated.

Suitable flexible sealing plugs 36 can be provided to close off the recess means 24 of the interconnection means 15 that are not being utilized for interconnecting to external pneumatic lines 17 and 17' in the manner illustrated in FIG. 2.

Therefore, it can be seen that the side 14 of the manifold means 11 of this invention not only detachably carries the control units 12 and 13 which can be readily plugged into and unplugged therefrom through the nipple means 21 and electrical pins 25 thereof, but also the side 14 of the manifold means 11 carries interconnection means 15 and 16 to readily permit external pneumatic and electrical lines 17, 17', 18 and 18' to be interconnected thereto in the desired pattern for controlling the units 12 and 13 through the internal pneumatic means 23 and electrical means 30 of the manifold means 11.

Further, it can be seen that the manifold means 1 of this invention can have the recess means 22 and 26 thereof arranged in any desired pattern to readily accept control devices of configurations different than the configurations of the control devices 12 and 13 of FIGS. 1–3.

Figure 4:
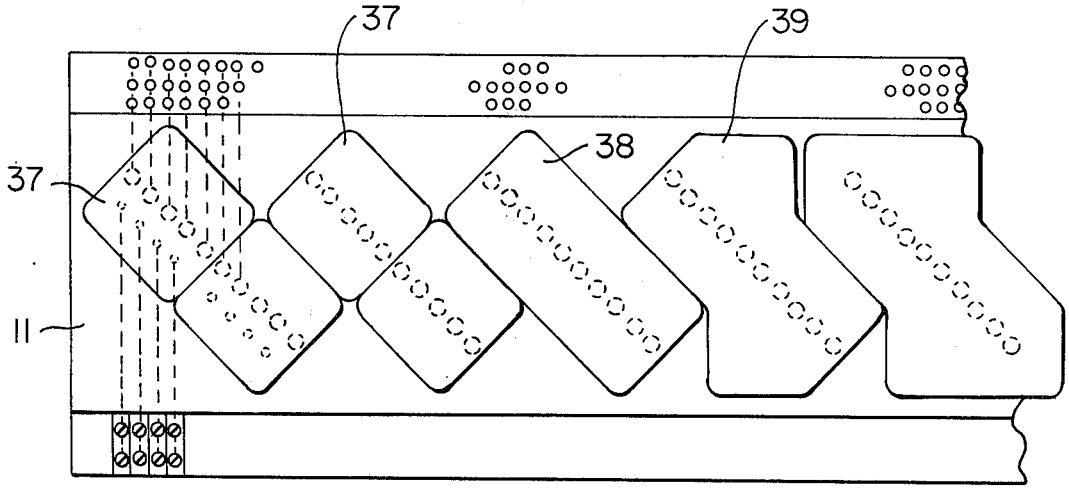
FIG. 4 is a view similar to FIG. 3 and illustrates another embodiment of the manifold system of this invention.

For example, substantially square, rectangular or irregularly shaped control devices 37, 38 and 39 as illustrated in FIG. 4 can be plugged into the manifold means 11.

Thus, it can be seen that this invention not only provides an improved manifolding system and manifold means therefor, but also this invention provides an improved method of making such a manifold means.

While the forms and methods of this invention now preferred have been illustrated and described as required by the Patent Statute, it is to be understood that other forms and method steps can be utilized and still fall within the scope of the appended claims.

What is claimed is:

1. In a combination of a manifold means detachably carrying on one side thereof a plurality of control units each of which is pneumatically and electrically operated and each of which is fluidly and electrically interconnected to pneumatic means and electrical means of said manifold means, the improvement wherein said one side of said manifold means has external interconnection means for said pneumatic means and said electrical means whereby external pneumatic and electrical lines can be interconnected to said interconnection means and thereby be interconnected to the same side of said manifold means that said units are interconnected thereto.

2. In a combination of a manifold means detachably carrying on one side thereof a plurality of control units each of which is pneumatically and electrically operated and each of which is fluidly and electrically interconnected to pneumatic means and electrical means of said manifold means, the improvement wherein said one side of said manifold means has external interconnection means for said pneumatic means and said electrical means whereby external pneumatic and electrical lines can be interconnected to said interconnection means and thereby be interconnected to the same side of said manifold means that said units are interconnected thereto, said control units having plug-in nipple means, said pneumatic means having a plurality of plug-in recess means respectively receiving said plug-in nipple means of said control units to fluidly interconnect therewith.

3. A combination as set forth in claim 1 wherein said pneumatic means comprises a plurality of internal passage means of said manifold means respectively leading from said external interconnection means for said pneumatic means to said plug-in recess means.

4. A combination as set forth in claim 3 wherein said interconnection means for each passage means comprises a plurality of plug-in recesses in said one side of said manifold means.

5. A combination as set forth in claim 4 wherein said plug-in recesses of said interconnection means for each passage means are disposed in spaced aligned relation in said one side of said manifold means.

6. A combination as set forth in claim 5 wherein said aligned plug-in recesses of said interconnection means for each passage means are disposed in aligned spaced parallel relation with the other aligned plug-in recesses for the other passage means.

7. In a combination of a manifold means detachably carrying on one side thereof a plurality of control units each of which is pneumatically and electrically operated and each of which is fluidly and electrically interconnected to pneumatic means and electrical means of said manifold means, the improvement wherein said one side of said manifold means has external interconnection means for said pneumatic means and said electrical means whereby external pneumatic and electrical lines can be interconnected to said interconnection means and thereby be interconnected to the same side of said manifold means that said units are interconnected thereto, said interconnection means for said electrical means comprising a plurality of external electrical terminals carried on said one side of said manifold means.

8. A combination as set forth in claim 7 wherein said terminals are disposed in aligned spaced parallel relation with each other on said one side of said manifold means.

9. In a combination of a manifold means detachably carrying on one side thereof a plurality of control units each of which is pneumatically and electrically operated and each of which is fluidly and electrically interconnected to pneumatic means and electrical means of said manifold means, the improvement wherein said one side of said manifold means has external interconnection means for said pneumatic means and said electrical means whereby external pneumatic and electrical lines can be interconnected to said interconnection means and thereby be interconnected to the same side of said manifold means that said units are interconnected thereto, said one side of said manifold means having a pair of opposed ends, said interconnection means for said pneumatic means being at one of said opposed ends of said one side, said interconnection means for said electrical means being at the other of said opposed ends of said one side, said manifold means having means detachably carrying said control units intermediate said opposed ends of said one side and inboard of said interconnection means thereof.

10. A combination as set forth in claim 9 wherein said interconnection means for said pneumatic means comprises a plurality of plug-in recesses disposed in aligned spaced relation in said one side of said manifold means at said one end thereof, said interconnection means for said electrical means comprising a plurality of external electrical terminals disposed in aligned spaced relation on said one side of said manifold means at said other end thereof.

* * * * *

UNITED STATES PATENT AND TRADEMARK OFFICE

CERTIFICATE OF CORRECTION

PATENT NO. : 4,165,139

DATED : August 21, 1979

INVENTOR(S) : Clarence M. Asbill, III

It is certified that error appears in the above—identified patent and that said Letters Patent is hereby corrected as shown below:

The term of this patent subsequent to June 6, 1995, has been disclaimed.

Signed and Sealed this

*Eighth* Day of *January 1980*

[SEAL]

*Attest:*

SIDNEY A. DIAMOND

*Attesting Officer*

*Commissioner of Patents and Trademarks*

UNITED STATES PATENT AND TRADEMARK OFFICE

CERTIFICATE OF CORRECTION

PATENT NO. : 4,165,139

DATED : August 21, 1979

INVENTOR(S) : Clarence M. Asbill III

It is certified that error appears in the above—identified patent and that said Letters Patent is hereby corrected as shown below:

Column 5, line 7, delete "1" and insert --2--.

Signed and Sealed this

*Twenty-eighth* Day of *July 1981*

[SEAL]

*Attest:*

GERALD J. MOSSINGHOFF

*Attesting Officer*

*Commissioner of Patents and Trademarks*